US010027058B2

(12) United States Patent
Guzeldereli et al.

(10) Patent No.: US 10,027,058 B2
(45) Date of Patent: Jul. 17, 2018

(54) ELECTRICAL CONNECTOR

(71) Applicant: Standard Car Truck Company, Rosemont, IL (US)

(72) Inventors: Yasin Guzeldereli, Brookfield, IL (US); Alan S. Walse, La Grange, IL (US); John D. Anderson, Oswego, IL (US)

(73) Assignee: Standard Car Truck Company, Rosemont, IL (US)

( * ) Notice: Subject to any disclaimer, the term of this patent is extended or adjusted under 35 U.S.C. 154(b) by 0 days.

(21) Appl. No.: 15/465,141

(22) Filed: Mar. 21, 2017

(65) Prior Publication Data

US 2018/0076564 A1 Mar. 15, 2018

Related U.S. Application Data

(60) Provisional application No. 62/393,444, filed on Sep. 12, 2016.

(51) Int. Cl.

| | |
|---|---|
| ***H01R 13/627*** | (2006.01) |
| ***H01R 24/84*** | (2011.01) |
| ***H01R 13/52*** | (2006.01) |
| *H01R 103/00* | (2006.01) |

(52) U.S. Cl.

CPC ..... *H01R 13/6271* (2013.01); *H01R 13/521* (2013.01); *H01R 24/84* (2013.01); *H01R 2103/00* (2013.01)

(58) Field of Classification Search

CPC ... H01R 13/6271; H01R 13/521; H01R 24/84
USPC ..... 439/284, 287, 293, 352–354, 736, 936
See application file for complete search history.

(56) References Cited

U.S. PATENT DOCUMENTS

| | | | | |
|---|---|---|---|---|
| 2,384,267 | A * | 9/1945 | Andersen | H01R 24/84 439/284 |
| 2,386,177 | A | 10/1945 | Andersen | |
| 3,270,267 | A | 8/1966 | Nolte, Jr. | |
| 4,963,102 | A | 10/1990 | Gettig et al. | |
| 5,046,968 | A | 9/1991 | Baur et al. | |

(Continued)

OTHER PUBLICATIONS

AAR Manual of Standards and Recommended Practices, Electronically Controlled Brake Systems, "ECP Cable-Based Brake System Cable, Connectors, and Junction Boxes—Performance Specification" Standard S-4210, Adopted: 1999; Last Revised: 2014, (28 pages).

(Continued)

*Primary Examiner* — Khiem Nguyen
(74) *Attorney, Agent, or Firm* — Neal, Gerber & Eisenberg LLP

(57) ABSTRACT

An improved electrical connector including a latch strike plate, a body having a base, a receiver extending from the base and configured to receive the latch strike plate, an inserter extending from the base, a first electrical connection assembly extending through the body, a second electrical connection assembly extending through the body, an electrical linkage cable assembly connected to the base, the first electrical connection assembly, and the second electrical connection assembly, a latching mechanism partially positioned in the base and the inserter and partially extending from the base and the inserter, and a securing assembly extending in and from the base.

48 Claims, 11 Drawing Sheets

(56) References Cited

U.S. PATENT DOCUMENTS

| | | | | |
|---|---|---|---|---|
| 5,259,780 | A * | 11/1993 | Morrissey, III | H01R 13/28 439/292 |
| D395,282 | S | 6/1998 | Rudoy et al. | |
| 5,800,196 | A | 9/1998 | Rudoy et al. | |
| 5,906,505 | A | 5/1999 | McCurdy, Jr. et al. | |
| D410,625 | S | 6/1999 | Kerek et al. | |
| 6,109,938 | A | 8/2000 | Meslet et al. | |
| 6,250,974 | B1 | 6/2001 | Kerek | |
| 7,955,109 | B2 | 6/2011 | Toner | |
| 9,437,961 | B1 * | 9/2016 | Smajda | H01R 13/28 |

OTHER PUBLICATIONS

Picture of Wabtec ECP Inter-car Connector, Available prior to Sep. 12, 2016, (1 page).

New York Air Brake Product Brochure of EP-60 Overlay Control Valve including Various Components, www.nyabproducts.com/ep-60-control-valve/, Available prior to Sep. 12, 2016, (3 pages).

* cited by examiner

ELECTRICAL CONNECTOR

PRIORITY CLAIM

This application claims priority to and the benefit of U.S. Provisional Patent Application 62/393,444, filed Sep. 12, 2016, the entire contents of which are incorporated herein by reference.

BACKGROUND

The railroad industry employs a variety of railroad cars and particularly freight railroad cars for transporting different types of products. The braking systems on freight railroad cars have conventionally been pneumatically controlled and operated. The locomotive typically provides the air pressure for such pneumatically controlled and operated braking systems. The typical freight railroad car braking system automatically applies the brakes in the absence of a sufficient level of air pressure and automatically releases the brakes in the presence of the sufficient level of air pressure. In such pneumatically controlled and operated braking systems, the brakes on all of the freight railroad cars in a train are typically either in a set mode or in a released mode (except during changing air pressure conditions such as when the air pressure is changing to apply or release the brakes due to time required for the change in air pressure to reach each of the railroad cars in the train).

There is a long recognized need in the railroad industry for braking systems that separately or individually control the brakes of each individual freight railroad car. This individual control would facilitate the braking system on each freight railroad car being remotely operated by the train engineer from the locomotive cab. This would provide many advantages. For example, this allows for graduated braking on and graduated braking off.

There are several ways this can be done with a suitable computer system that enables signals to be sent to selected freight railroad cars or to an individual car from a central location, i.e., the locomotive, which would permit the brakes of one or more of the freight railroad cars to be applied independently of the operation of the brakes in other freight railroad cars. In addition, any electrical path from the locomotive to the freight railroad cars coupled thereto would enable electrical signals to be sent to and received from the individual freight railroad cars so that information concerning any malfunction of the braking system in each freight railroad car could be relayed to the locomotive to provide a warning signal etc.

Electrical connectors have been developed to facilitate such electrically controlled (or electro-pneumatically controlled) braking systems on freight railroad cars. More specifically, electrical connectors have been developed to be positioned in series between each set of adjacent freight railroad cars (in the area of the coupling devices between such adjacent freight railroad cars) so that electric signals can be sent to any such freight railroad car for remotely activating (or integrating) various components that might be mounted to the freight railroad cars. Since either end of a freight railroad car can be positioned towards the locomotive, what has sometimes been referred to as a "hermaphroditic" electrical connector, has been commercially used at opposing ends of each freight railroad car to provide the necessary electrical connections between adjacent freight railroad cars.

Such known "hermaphroditic" electrical connectors are capable of being disconnected manually or automatically when adjacent freight railroad cars are separated. The air supply system is also disconnected on the selected freight railroad car either manually or automatically when a freight railroad car is separated from an adjacent freight railroad car whereby air pressure in the braking system for the uncoupled freight railroad cars is released, thereby automatically causing the brakes in the separated freight railroad cars to be set. Any electrical connection between the freight railroad cars must accommodate such coupling and uncoupling operation between adjacent freight railroad cars.

In addition, the electrical connector or connections must be capable of tolerating adverse weather conditions such as rain, freezing temperatures, etc.

One electrical connector for these purposes is generally described in U.S. Pat. No. 5,800,196.

One known electrical connector referred to as an ECP Intercar Cable is based on U.S. Pat. No. 5,800,196. This electrical connector is commercially available from New York Air Brake, and used for electrically connecting freight railroad cars. More specifically, this ECP Inter-Car Cable and associated lanyard is used to connect the 230 VDC Trainline between ECP freight railroad cars and locomotives. The cable complies with the S-4210 Standard and has been approved by the AAR for use on S-4200 compliant ECP trains. The connector end is configured to enable adjacent freight railroad cars and locomotives to be easily connected and disconnected. When in operation, the cable and lanyard lengths are specified to pull apart prior to the brake pipe separating to initiate an ECP Emergency. This known electrical connector is partially illustrated in FIGS. 1, 2A, 2B, and 3, and is generally indicated by numeral 10. Various issues have arisen with this known commercially available electrical connector 10 when used in connection with freight railroad cars.

The first such issue with this known electrical connector 10 relates to the force needed to disconnect the electrical connector 10 from another identical electrical connector 10. This known electrical connector 10, when in use, has resulted in inconsistent disconnection forces to disconnect two such connected electrical connectors 10 over the life of such electrical connectors 10. More specifically, when such commercially available electrical connectors are new or relatively new, higher or greater forces are needed to disconnect two such connected electrical connectors 10. As such electrical connectors are used and repeatedly connected and disconnected over time, the amount of force needed to disconnect such electrical connectors substantially reduces over time (i.e., with successive connection and disconnection cycles). This is due in part to wear on at least one of connection walls and particularly the connection wall 20 of this known electrical connector 10 as shown in FIGS. 2A and 2B. More specifically, FIG. 2A shows the connection wall 20 of this known commercially available electrical connector 10 before being used. FIG. 2B shows the connection wall 20 of this known commercially available electrical connector 10 after substantial use, and specifically shows the wear on the surface of connection wall 20 that occurs over time during use of this commercially available electrical connector 10.

The second issue with this known commercially available electrical connector 10 relates to the forces needed to actuate the latching mechanism of this electrical connector 10. The Association of American Railroads ("AAR") S-4200 7.3.4 requires that the mating force of the electrical connector 10 must never increase to the point that a "normal human being" has difficulty activating the latch of the latching mechanism. This known commercially available electrical connector 10 has a latching mechanism that is or can become in various instances relatively difficult for a normal human being to manually depress to disconnect two such commercially available electrical connectors from each other. The latch of this latching mechanism of this known commercially available electrical connector 10 is shown in FIG. 3, and is generally indicated by numeral 40. This latch includes a two section actuation arm that requires a relatively high amount of force to actuate the latching button.

The third issue with this known commercially available electrical connector 10 relates to the need for this electrical connector 10 to be water tight or prevent water ingression (when two such electrical connectors are connected to each other). This known commercially available electrical connector 10, in various instances in use, has permitted water ingression, and in certain reported instances, such water ingression has caused electrical shorts. This water ingression also results in reduced ability of such commercially available electrical connectors to communicate power and electrical signals (carrying data).

The fourth issue with this known commercially available electrical connector 10 also relates to the need for this electrical connector 10 to be water tight or prevent water ingression (when two such electrical connectors are connected to each other). This known commercially available electrical connector 10 is made from a material that absorbs moisture and that changes dimensions as it absorbs such moisture. The changes in dimension can also lead to water ingression.

Accordingly, there is a need to solve these problems, and specifically, a need for an improved electrical connector which solves these problems.

SUMMARY

Various embodiments of the present disclosure provide an electrical connector that solves the above problems. The electrical connector of the present disclosure can be considered a "hermaphroditic" electrical connector in that it is formed to be connected to an identically formed electrical connector for use (for example, to make an electrical connection between adjacent freight railroad cars for controlling the braking systems of such freight railroad cars). The electrical connector of the present disclosure can be considered a "hermaphroditic" electrical connector because it includes both an extending electrical post and an electrical socket. In use, the extending electrical post of a first one of the electrical connectors is positioned to be coupled to the electrical socket of a second one of the electrical connectors. Likewise, in use, the extending electrical post of the second one of these electrical connectors is positioned to be coupled to the electrical socket of the first one of the electrical connectors. It should be appreciated that the electrical connector of the present disclosure is also formed to be connected to the known commercially available electrical connectors described above (for example, to make an electrical connection between freight railroad cars for controlling the braking systems of such freight railroad cars).

In various embodiments, the electrical connector of the present disclosure includes a latch strike plate, a body having a base, a receiver extending from the base and configured to receive the latch strike plate, and an inserter extending from the base. The latch strike plate is attached to the body and provides the electrical connector with consistent uncoupling forces during the entire life of the electrical connector. The electrical connector further includes: (a) a first electrical connection assembly extending through the body, and (b) a second electrical connection assembly extending through the body. The first electrical connection assembly and the second electrical connection assembly include multiple co-acting improvements including: (a) O-rings; (b) potting compounds; and (c) enhanced engagement seals, that co-act to prevent or limit water ingress into the electrical connector when the electrical connector is connected to another such electrical connector. The electrical connector of the present disclosure further includes an electrical linkage cable assembly connected to the base, the first electrical connection assembly, and the second electrical connection assembly. The electrical connector of the present disclosure also includes an improved latching mechanism partially positioned in the base and the inserter and partially extending from the base, extendable from the inserter, and a securing assembly extending in and from the base. The latching mechanism is relatively easily manually depressed or actuated by a normal person. The body of the electrical connector of the present disclosure is also made from a liquid crystal polymer in various embodiments to limit water absorption by the body of the electrical connector, and thus prevent any substantial changes in the dimensions of the body due to water absorption by the body.

The electrical connector of the present disclosure thus solves the above problems by providing an electrical connector that: (i) requires consistent uncoupling forces during the entire life of the electrical connector; (ii) enables the latching mechanism to be relatively easily manually depressed or actuated by a normal person; (iii) prevents or limits water ingress into the electrical connector when the electrical connector is connected to another such electrical connector; and (iv) limits water absorption by the body of the electrical connector.

Other objects, features and advantages of the present invention will be apparent from the following detailed disclosure, taken in conjunction with the accompanying sheets of drawings, wherein like reference numerals refer to like parts.

DETAILED DESCRIPTION

Figure 9:
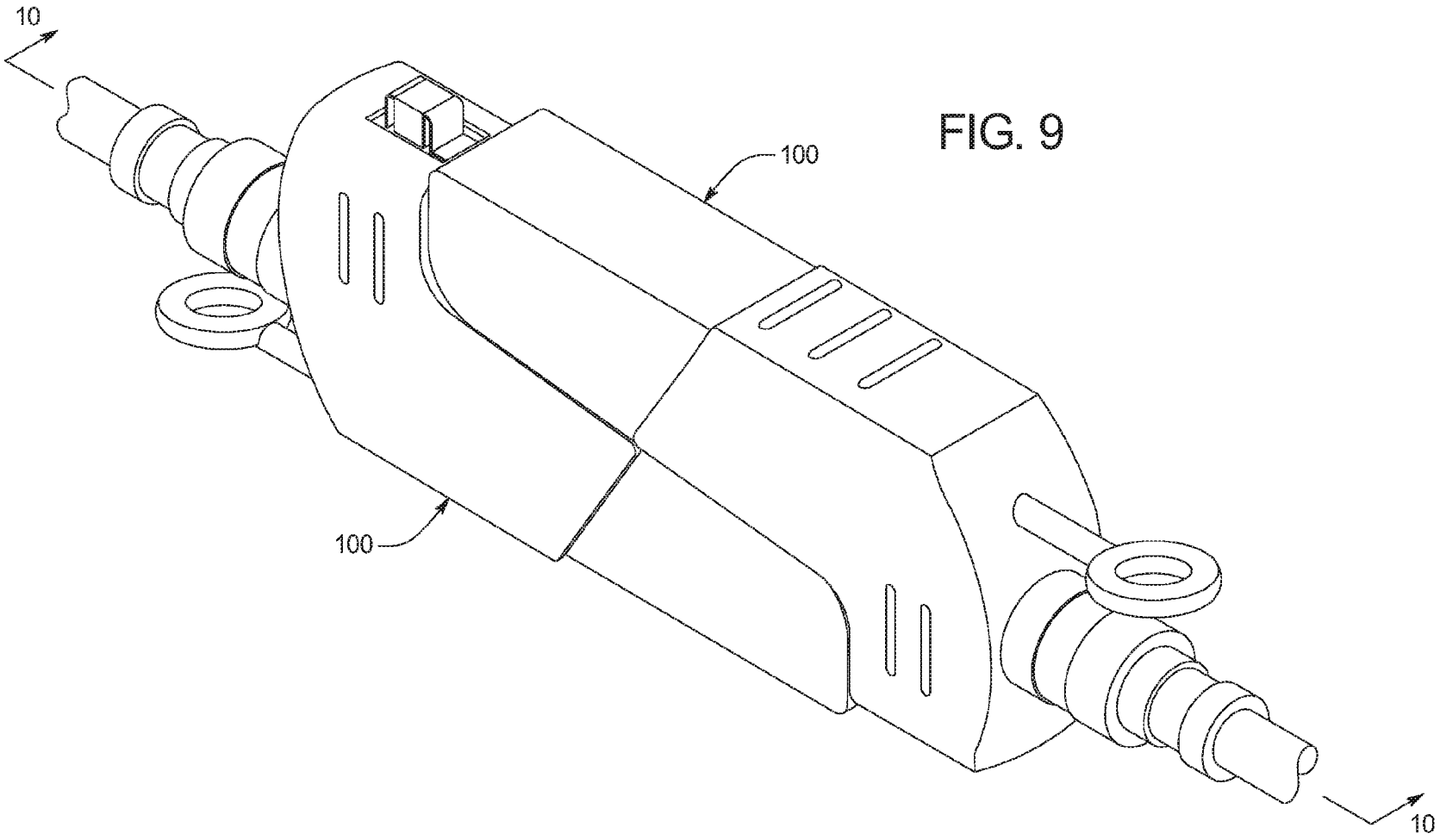
FIG. 9 is a side perspective view of two identical electrical connectors of FIG. 4 attached to each other.
Figure 10:
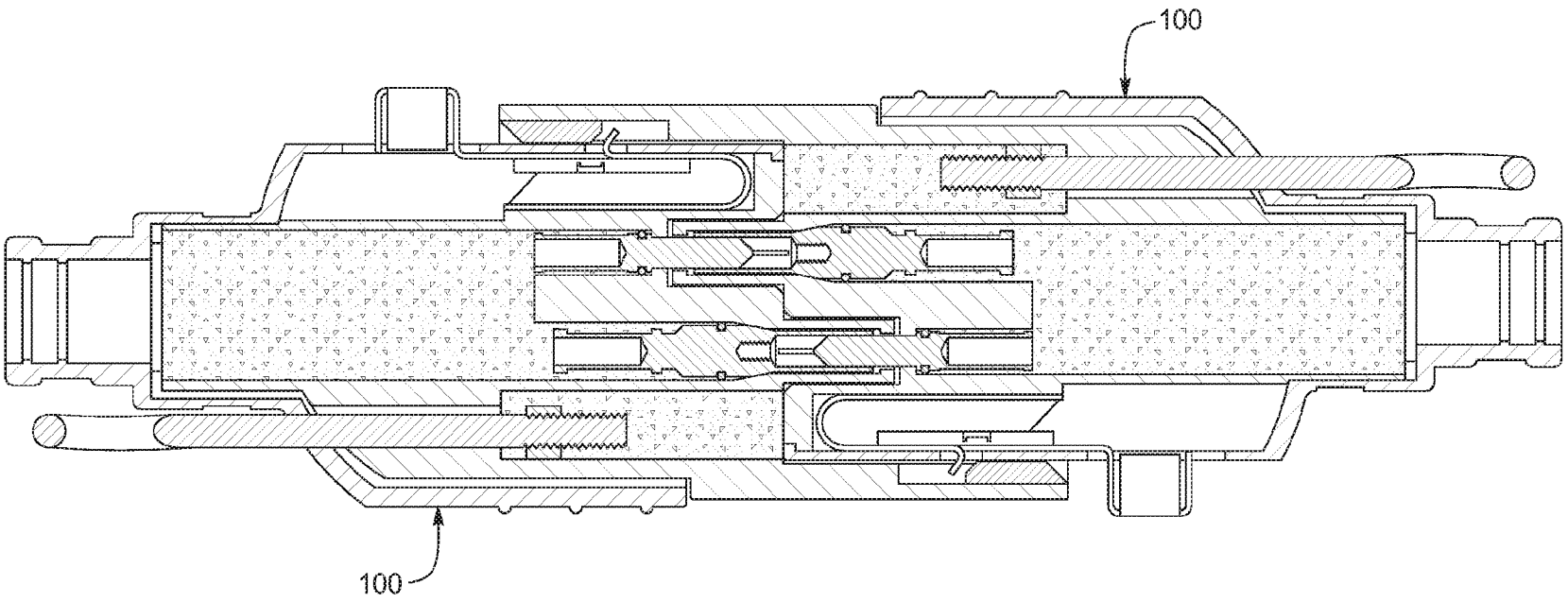
FIG. 10 is a cross sectional view of the attached two identical electrical connectors of FIG. 9 taken substantially through line 10-10 of FIG. 9.

Referring now to FIGS. 4 to 10, one example embodiment of the electrical connector of the present disclosure is illustrated and generally indicated by numeral 100. The electrical connector 100 is configured to be connected and disconnected to the known commercially available electrical connector 10 described above, and alternatively to another identical or similar electrical connector 100 of the present disclosure (as generally shown in FIGS. 9 and 10). The electrical connector 100 can be used for various different applications and industrial uses and is particularly configured for providing an electrical connection between adjacent railroad cars such as adjacent freight railroad cars (not shown). The electrical connector 100 can also be used to provide an electrical connection between a freight railroad car and a locomotive (not shown). The electrical connector 100 can also be used to provide electrical connections between other railroad cars (not shown). It should be appreciated that when two such electrical connectors of the present disclosure are connected, one electrical connector is inverted with respect to the other electrical connector, as generally illustrated in FIGS. 9 and 10. It should also be appreciated that when the electrical connector 100 of the present disclosure is connected to another electrical connector such as the known electrical connector 10, one of these electrical connectors is inverted with respect to the other electrical connector. It should further be appreciated that, in various embodiments of the present disclosure, certain components of the electrical connector 100 of the present disclosure are similar to the electrical connector of U.S. Pat. No. 5,800,196, and thus U.S. Pat. No. 5,800,196 is incorporated herein by reference.

As further described below, the electrical connector 100 of the present disclosure solves the above described problems with electrical connector 10 by providing an improved electrical connector that: (i) requires consistent uncoupling forces during the entire life of the electrical connector; (ii) enables the latching mechanism to be relatively easily manually depressed or actuated by a normal person; (iii) prevents or limits water ingress into the electrical connector (when the electrical connector 100 is connected to another such electrical connector 100 or known electrical connector 10); and (iv) limits water absorption by the body of the electrical connector.

More specifically, the illustrated example electrical connector 100 of the present disclosure includes a body generally having: (a) base 200; (b) a receiver 300 extending from the base 200; and (c) an inserter 400 extending from the base 200. The electrical connector 100 or body thereof generally extends along a longitudinal axis, has an electrical wire connection end, and an opposing connection or coupling end that is configured to receive or mate with the connection or coupling end of another or second electrical connector 100 (as generally shown in FIGS. 9 and 10). In this illustrated example embodiment, the base 200, the receiver 300, and the inserter 400 of the electrical connector 100 are made from a suitable plastic, and in various embodiments, from a liquid crystal polymer (as opposed to the body of the known electrical connector 10 described above that is made from a Nylon which is more hygroscopic and thus is more detrimentally affected by water or moisture). The liquid crystal polymer material provides the electrical connector of the present disclosure with a lower level of absorption of moisture than the known electrical connector 10, and thus has substantially less dimensional changes due to any water absorption. Additionally, the present body that is molded from a liquid crystal polymer is also less electrically affected than the body of the known electrical connector 10 which is made from a Nylon. It should be appreciated that the base 200, the receiver 300, and the inserter 400 of the electrical connector 100 could be made from one or more alternative materials in alternative embodiments.

In various embodiments of the present disclosure, the base 200 can include a resilient jacket covering part or the entire base or can form part of the base. In this illustrated example embodiment, the jacket is made from a suitable flexible thermoplastic elastomer but could alternatively be made from a thermoplastic/thermoset urethane, rubber or other material. It should be appreciated that the jacket could be made from one or more alternative materials.

The illustrated example electrical connector 100 further includes a latch strike plate 390 suitably attached to the receiver 300 as best shown in FIGS. 5, 6A, 6B, 7, and 10 as further discussed below. The illustrated example electrical connector 100 further includes: (i) a first electrical connection assembly 500 extending through base 200 and the inserter 400; (ii) a second electrical connection assembly 600 extending through the base 200 and the inserter 400; (iii) an electrical linkage cable assembly 700 connected by wires (not shown) extending through the base 200 to the first electrical connection assembly 500 and to the second electrical connection assembly 600; (iv) a latching mechanism 800 partially positioned in the base 200 and the inserter 400 and partially extending from the base 200, and partially extending from the inserter 400; and (v) a securing assembly 900 secured in, extending in, and extending from the base 200.

More specifically, the base 200 of this illustrated assembly embodiment of the present disclosure generally includes: (a) a first or bottom wall 210; (b) a second or top wall 220 spaced apart from the first or bottom wall 210; (c) a first side wall 230 connected to the first wall 210 and the second wall 220; (d) a second side wall 240 connected to the first wall 210 and the second wall 220; (e) a first or outer end wall 250 connected to the first wall 210, the second wall 220, the first side wall 230, and the second side wall 240.

In various embodiments, the base 200 includes a jacket 260 covering part or all of the base 200 or forming part of the base 200. For example, in this illustrated embodiment, the jacket 260 includes member 270 that covers the wall 210 on the bottom side of the base 200. In this illustrated embodiment, the jacket 260 also includes a member that forms the wall 220 on the top side of the base 200.

The receiver 300 of this illustrated example embodiment of the present disclosure includes: (a) a first wall 310 connected to and extending from the first wall 210 of the base 200; (b) a first sidewall 330 connected to an extending from the first side wall 230 of the base 200, and extending transversely from the first wall 310; and (c) a second side wall 340 connected to and extending from the second side wall 240 of the base 200, and extending transversely from the first wall 310. The first wall 310 includes an outer surface 350 and an inner surface 360. The inner surface 360 defines: (1) a latch receiver or receiving area 370; and (2) a latch strike plate receiver or receiving area 380. Thus, the receiver 300 is configured to have the latch strike plate 390 connected to the first wall 310 of the receiver 300 in the latch strike plate receiver or receiving area 380 as further described below.

In this illustrated embodiment, the latch receiver or receiving area 370 is defined by: (a) an upstanding transversely extending first wall 372 extending from the inner surface 360 of first wall 310 partially toward the outer surface 350 of the first wall 310; (b) an upstanding longitudinally extending first side wall 373 extending from the inner surface 360 of first wall 310 partially toward the outer surface 350 of the first wall 310; (c) an upstanding longitudinally extending second side wall 374 extending from the inner surface 360 of first wall 310 partially toward the outer surface 350 of the first wall 310; and (d) a generally flat bottom wall 375 extending parallel or substantially parallel to the inner surface 360 and transversely to the upstanding first wall 372, the first side wall 373, and the second side wall 374. The latch receiver or receiving area 370 is further defined by an upstanding end wall of the latch strike plate 390 as further discussed below. The latch receiver or receiving area 370 is configured to receive a latch 840 of the latching mechanism 800 of an opposing electrical connector 100 as generally shown in FIG. 10.

The latch strike plate receiver or receiving area 380 is defined by: (a) an upstanding longitudinally extending first side wall 383 extending from the inner surface 360 of first wall 310 partially toward the outer surface 350 of the first wall 310; (b) an upstanding first generally partially transversely or outwardly extending U-shaped side wing wall 383*a* extending from the inner surface 360 of the first wall 310 partially toward the outer surface 350 of the first wall 310 and defining a first latch strike plate wing receiver, wing receipt area, or wing receiving pocket; (c) an upstanding longitudinally extending second side wall 384 extending from the inner surface 360 of the first wall 310 partially toward the outer surface 350 of the first wall 310; (d) an upstanding second generally partially transversely or outwardly extending U-shaped side wing wall 384*a* extending from the inner surface 360 of the first wall 310 partially toward the outer surface 350 of the first wall 310 and defining a second latch strike plate wing receiver, wing receipt area, or wing receiving pocket; and (e) a generally flat bottom wall 385 extending parallel or substantially parallel to the inner surface 360 and transversely to the first side wall 383 and second side wall 384. The upstanding first generally U-shaped side wing wall 383*a*, the upstanding second generally U-shaped side wing wall 384*a*, and the bottom wall 385 thus define opposing latch strike plate wing receivers, wing receipt areas, or wing receipt pockets that are configured to receive and hold the opposing attachment wings of the latch strike plate 390 as further described below.

The latch strike plate 390 of this example embodiment includes a solid metal latch strike plate body such as a steel latch strike plate body. It should be appreciated that the latch strike plate of the present disclosure can be made from other suitable materials. The latch strike plate body of the latch strike plate 390 of this example embodiment includes: (a) a first or bottom generally flat surface 391; (b) a second or top generally flat surface 392; (c) an upstanding partially angled transverse first end wall 393 extending from the first or bottom surface 391 to the second or top surface 392; (d) an upstanding angled transverse second end wall 394 extending from the first or bottom surface 391 to the second or top surface 392; (e) an upstanding first side wall 395 extending from the first or bottom surface 391 to the second or top surface 392; (f) an upstanding second side wall 396 extending from the first or bottom surface 391 to the second or top surface 392; (g) a first attachment wing 397 extending outwardly from the first side wall 395; and (h) a second attachment wing 398 extending outwardly from the second side wall 396.

The upstanding partially angled transverse first end wall 393 that extends from the first or bottom surface 391 to the second or top surface 392 includes a first upstanding section 393*a* and a second angled section 393*b*. The first angled section 393*a* defines a part of the latch receiver or receiving area 370 as mentioned above. The second angled section 393*b* also defines a part of the latch receiver or receiving area 370 as mentioned above.

Figure 6A:
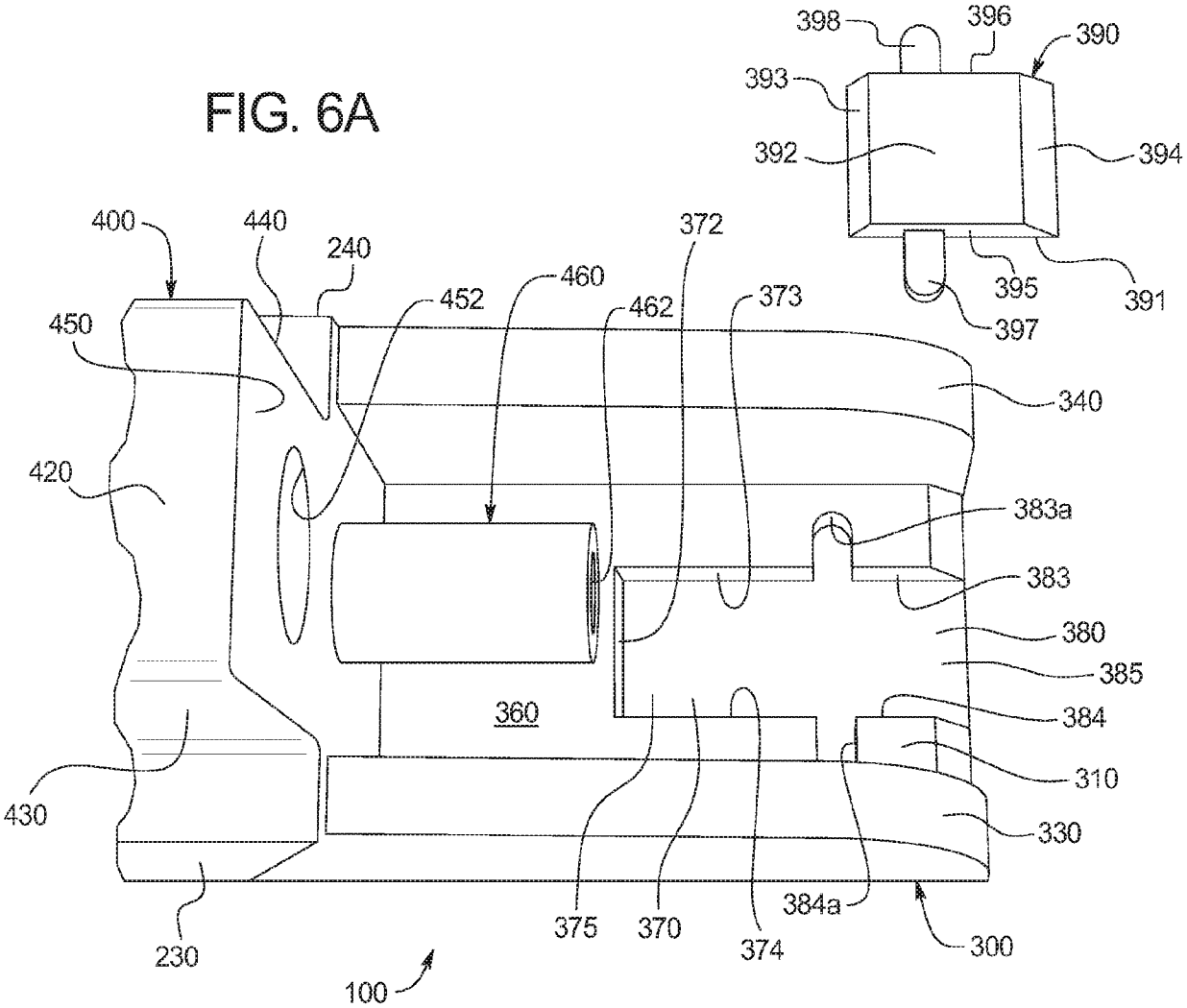
FIG. 6A is an exploded fragmentary top perspective view of a front portion of the electrical connector of FIG. 4, showing the latched strike plate before being attached to the receiver of the electrical connector.
Figure 6B:
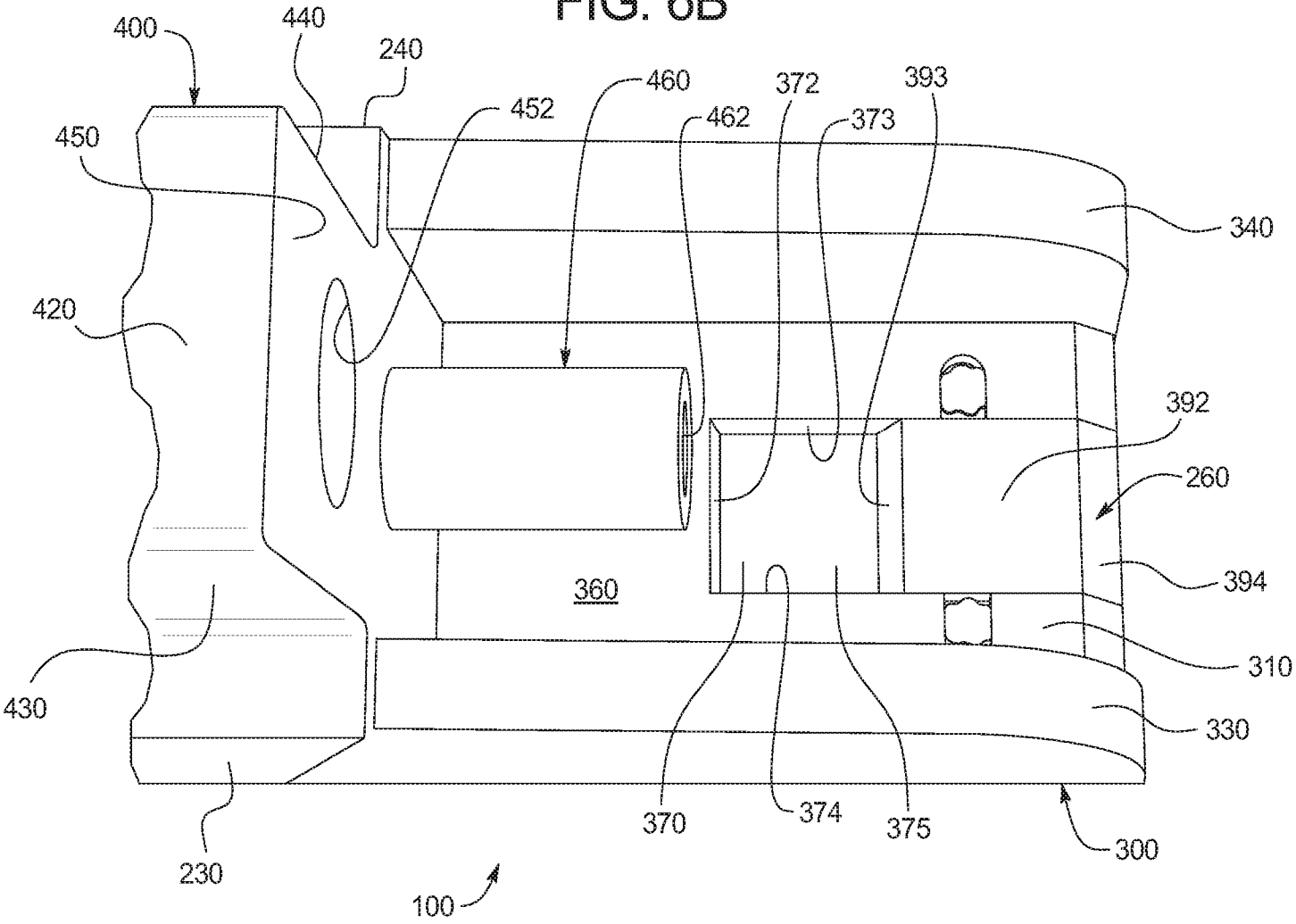
FIG. 6B is a fragmentary top perspective view of a front portion of the electrical connector of FIG. 4, showing the latch strike plate attached to the receiver of the electrical connector.
Figure 7:
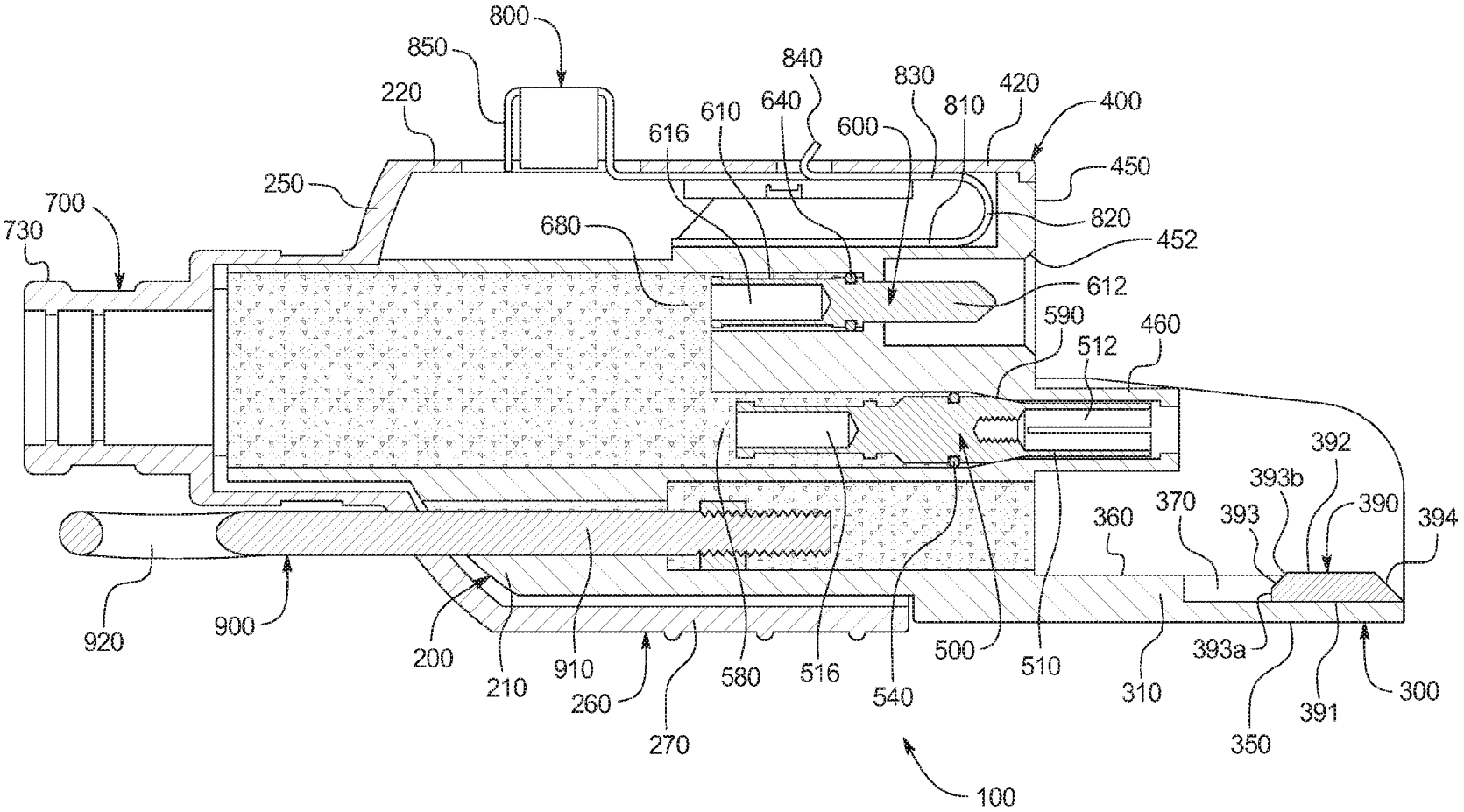
FIG. 7 is a cross sectional view of the electrical connector of FIG. 4, taken substantially through line 7-7 of FIG. 5.
Figure 8:
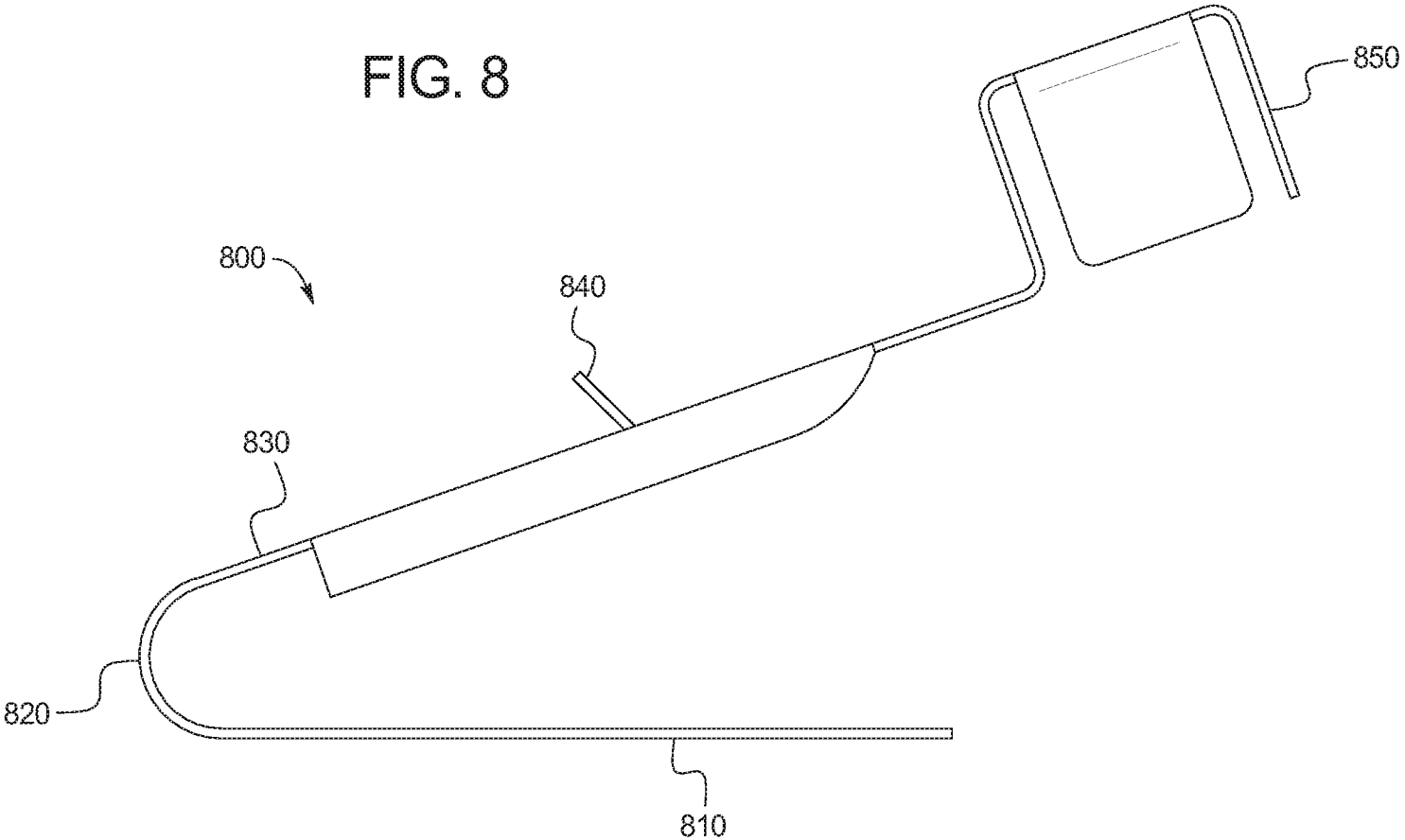
FIG. 8 is a side view of part of the latching mechanism of the electrical connector of FIG. 4.

The latch strike plate body of the latch strike plate 390 is configured to be received in the strike plate receiver or receiving area 380 such that: (a) the first or bottom generally flat surface 391 is positioned toward and on the bottom wall 385 that partially defines the latch strike plate receiver or receiving area 380; (b) the second or top generally flat surface 392 faces in the same direction as the bottom wall 385 that partially defines the latch strike plate receiver or receiving area 380; (c) the upstanding partially angled transverse first end wall 393 extending from the first or bottom surface 391 to the second or top surface 392 faces the upstanding transverse first wall 372 that partially defines the latch receiver or receiving area 370; (d) the upstanding angled transverse second end wall 394 faces outwardly and generally in the same direction as the upstanding transverse first wall 372 that partially defines the latch receiver or receiving area 370; (e) the upstanding first side wall 395 faces and in this example embodiment engages the upstanding longitudinal second side wall 384 that defines the latch strike plate receiver or receiving area 380; (f) the upstanding second side wall 396 faces and in this example embodiment engages the upstanding longitudinal first side wall 383 that defines the latch strike plate receiver or receiving area 380; (g) the first attachment wing 397 is positioned in the wing receipt pocket defined by the upstanding second generally partially transversely or outwardly extending U-shaped side wing wall 384*a*; and (h) the second attachment wing 398 is positioned in the wing receipt pocket defined by the upstanding second generally partially transversely or outwardly extending U-shaped side wing wall 383*a*. The first attachment wing 397 is thus configured to be received in and held in the first latch strike plate wing receiver, wing receipt area, or pocket. Likewise, the second attachment wing 398 is thus configured to be received in and held in the second latch strike plate wing receiver, wing receipt area, or pocket. During assembly, after the first attachment wing 397 is positioned in the first latch strike plate wing receiver, wing receipt area, or pocket and the second attachment wing 398 is positioned in the second latch strike plate wing receiver, wing receipt area, or pocket, the plastic adjacent to the pockets is melted (such as by an ultrasonic plastic welding machine) such that the melted plastic covers the first attachment wing 397 and the second attachment wing 398 to secure those wings in the pockets and to secure the entire latch strike plate 390 to the receiver 300 as shown in FIG. 6B. It should be appreciated that additional plastic material may be employed for this wing and latch strike plate securement process. It should also be appreciated that other suitable latch strike plate securement methods may be employed in accordance with the present disclosure. For example, in alternative embodiments, the latch strike plate is molded into the strike plate receiver or receiving area during molding of the body.

The latch strike plate 390 of the present disclosure prevents the wear on the connection wall and particularly on the bottom wall 310 of the receiver 300 over time during use of this electrical connector 100. This electrical connector 100, when in use, requires consistent disconnection forces to disconnect two such connected electrical connectors 100 over the life of such electrical connectors 100. The amount of the disconnection forces does not change when electrical connectors 100 are repeatedly connected and disconnected over time. Applicant has tested this illustrated example embodiment, and such tests confirm a consistent disconnection force of approximately 100 lbs. It should also be appreciated that the present disclosure contemplates that this consistent force can be changed by changing one or more angles of the walls of the latch strike plate.

The inserter 400 of this illustrated example embodiment of the present disclosure includes: (a) a first or top wall 420 extending from wall 220 of the base 200; (b) a first side wall 430 connected to the top wall 420; (c) a second side wall 440 spaced apart from the first side wall 440 spaced apart from the first side wall 430 and connected to the top wall 420; (d) an end wall 450 connected to the top wall 420, the first side wall 430, and the second side wall 440; and (e) an extension tube 460 connected to and extending from the end wall 450. The end wall 450 defines electrical socket receipt opening 452. The extension tube 460 defines an electrical posts receipt opening 462. The inserter 400 of the electrical 100 is configured to at least partially fit into a receiver of another same electrical connector 100 as generally shown in FIGS. 9 and 10. When two such electrical connectors 100 are connected as shown in FIGS. 9 and 10, (a) the extension tube 460 extending from the end wall 450 of a first one of the electrical connectors 100 extends into the connector receipt opening 452 of the second one of the electrical connectors 100, and (b) the extension tube 460 extending from the end wall 450 of the second one of the electrical connectors 100 extends into the connector receipt opening 452 of the first one of the electrical connectors 100.

The first electrical connection assembly 500 of this illustrated example embodiment of the present disclosure generally includes: (a) a first electrical member 516 including an electrical socket 512 fixedly positioned in and extending through a first longitudinally extending bore, chamber, or cavity 510 in or defined by the inserter 400; (b) a first wire (not shown) connected to the first electrical member 516; (c) a first O-ring 540 extending in the first longitudinally extending bore, chamber, or cavity 510 and around the electrical member 516; and (d) potting compound 580 positioned partially around a central portion of the first electrical member 516. The electrical socket 512 is partially positioned in the extension tube 460. This O-ring 540 serves at least two different purposes. When the potting compound is introduced into the first cavity 510 during assembly of the electrical connector 100, the O-ring 540 prevents the potting compound from leaking into the electrical socket 512, and thus prevents the potting compound from potentially contaminating the contact surface of the electrical socket 512. In use, the O-ring 540 also prevents water from entering through any space between the first electrical member 516 and the interior wall that defines the first cavity 510 in which the first electrical member 516 sits or is positioned. In this illustrated example embodiment, the first electrical member 516 including the electrical socket 512 is made from a 95% conductive copper alloy such as a conductive beryllium copper and is also gold plated. It should be appreciated that the first electrical member including the electrical socket can be made from other suitable materials in accordance with the present disclosure.

The second electrical connection assembly 600 of this illustrated example embodiment of the present disclosure includes: (a) a second electrical member 616 including an electrical post 612 fixedly positioned in and extending through a second longitudinally extending bore, chamber, or cavity 610 in or defined by the inserter 400; (b) a second wire (not shown) connected to the second electrical member 616; (c) a second O-ring 640 extending in the second longitudinally extending bore, chamber, or cavity 610 and around a central portion of the second electrical member 616; and (d) potting compound 680 positioned around the second electrical member 616. This O-ring 640 serves at least two different purposes. When the potting compound is introduced into the second cavity 610 during assembly of the electrical connector 100, the O-ring 640 prevents the potting compound from leaking onto surface of the electrical post 612 and thus prevents the potting compound from potentially contaminating the contact surface of the electrical post 612. In use, the O-ring also prevents water from entering through any space between the second electrical member 616 and the interior wall that defines the second cavity 610 in which the second electrical member 616 sits or is positioned. In this illustrated example embodiment, the second electrical member 616 including the electrical post 612 is made from a 95% conductive copper alloy and is also gold plated. It should be appreciated that the second electrical member including the electrical post can be made from other suitable materials in accordance with the present disclosure.

The electrical members including the electric post and electric socket of this illustrated example embodiment are more conductive than the brass electrical post and electrical socket of the prior known electrical connectors 10 discussed above. More specifically, such known brass electrical connectors provide about ⅓ of the conductivity of electrical socket and electrical post of this illustrated example embodiment of the present disclosure.

In this illustrated embodiment, the electrical members including the electrical post and electrical socket are positioned after molding of the body of the electrical connector 100 and then potted or secured in-place using the urethane potting compound. The potting compound assists in securing the electrical members in the cavities that define the areas in which the electrical members are positioned. The potting compound also eliminates any voids between the electrical members including the electrical post and electrical socket and the walls of the cavities that define the areas in which the electrical members are positioned, thus preventing water ingress into the cavities of the inserter.

In this illustrated embodiment, the first electrical member 516 is configured to be positioned to provide an enhanced cylindrical tapered engagement seal 590 between a tapered outer surface of the first electrical member 516 and a tapered inner surface of inserter 400 that defines the first cavity 510. This part of the outer surface of the first electrical member 516 and this part of the inner surface of the inserter 400 that defines the first cavity are specifically dimensioned and configured to limit or eliminate any space between such surfaces. Additionally, the electrical socket 512 defines an interior threaded surface which is configured to receive a threaded assembly tool such as a bolt (not shown) during the assembly process. During assembly of the electrical connector 100, the assembly tool is inserted in and rotated in the electrical socket 512 to secure the assembly tool to the electrical socket 512. Thereafter, the assembly tool can be used to position the first electrical member 516 (i.e., move the first electrical member 516 to the right as far as possible in the cavity 510 to the position shown in FIG. 7) to form the enhanced engagement seal 590. It should be appreciated that other suitable assembly tools and processes can be used in accordance with the present disclosure. It should also be appreciated that additional engagement seals can be employed with the electrical members in accordance with the present disclosure.

The electrical linkage cable assembly 700 of this illustrated example embodiment of the present disclosure includes: (a) a first wire (not shown) connected to the first wire (not shown) of the first electrical connection assembly 500; (b) a second wire (not shown) connected to the second wire (not shown) of the second electrical connection assembly 600; (c) a protective outer tube 730 surrounding the first wire and the second wire; and (d) a suitable attachment mechanism connecting the protective outer tube 730 and the first end wall 250 of the base 200.

Figure 1:
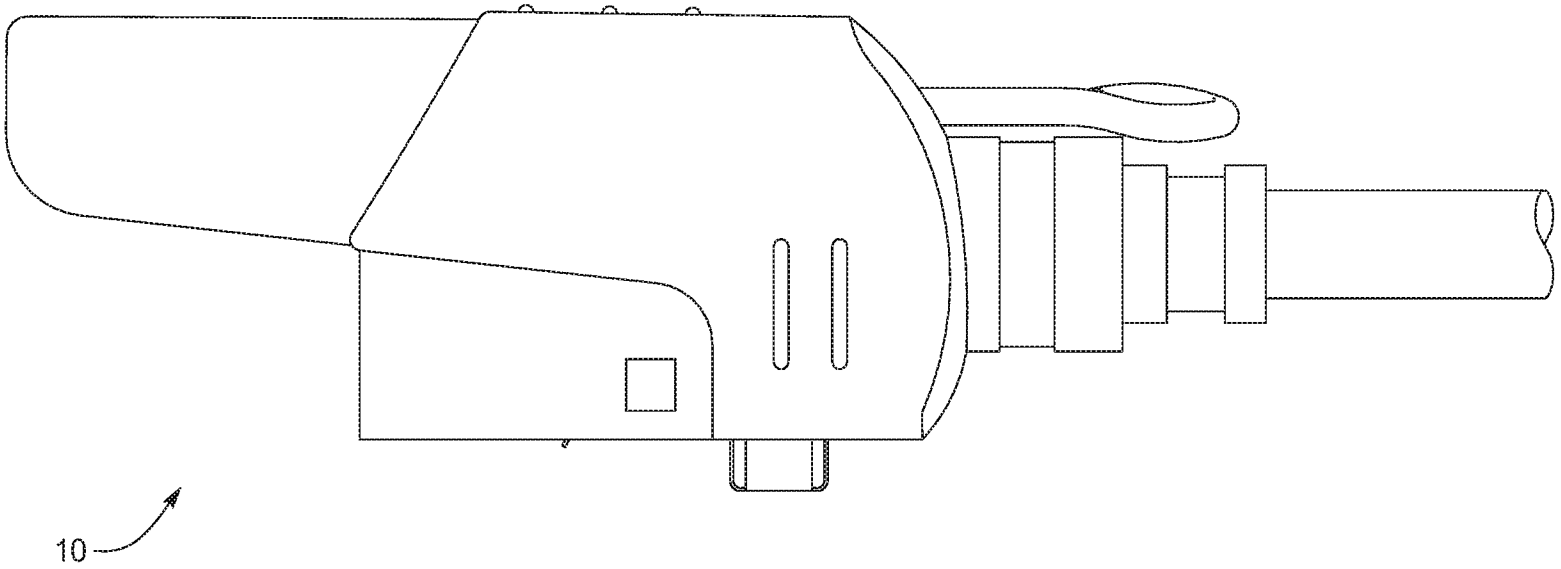
FIG. 1 PRIOR ART
FIG. 1 is a side perspective view of a known commercially available electrical connector (with the electrical cord connected thereto shown in fragmentary).
Figure 2A:
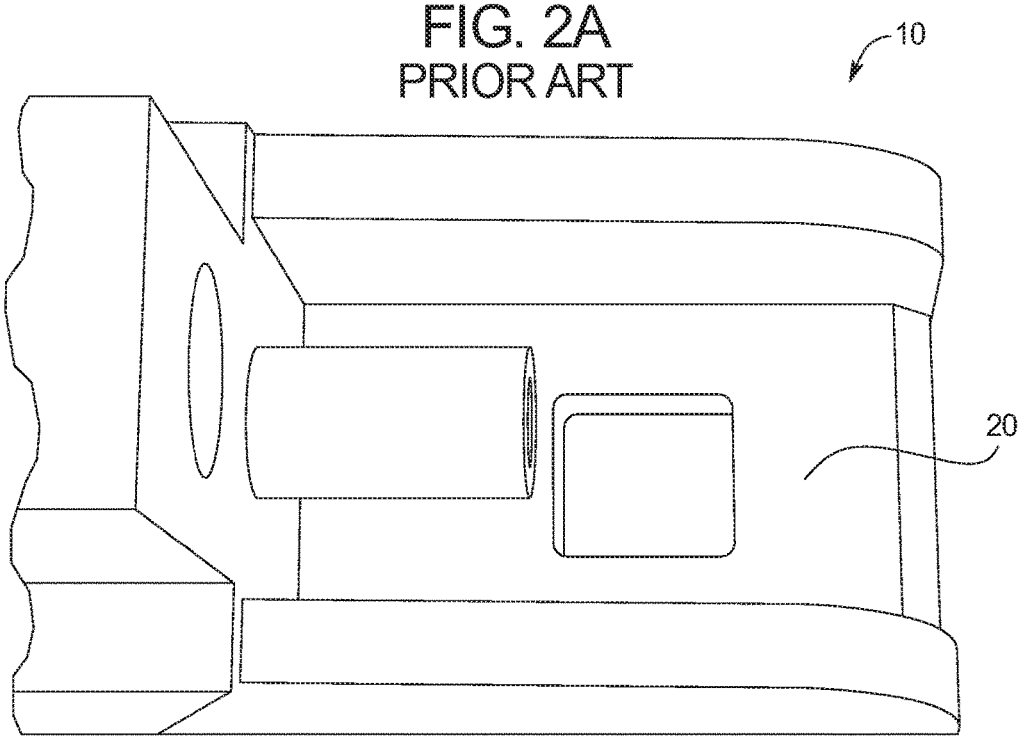
FIG. 2A PRIOR ART
FIG. 2A is a fragmentary top perspective view of a front or connection portion of the known commercially available electrical connector of FIG. 1, shown before being used.
Figure 2B:
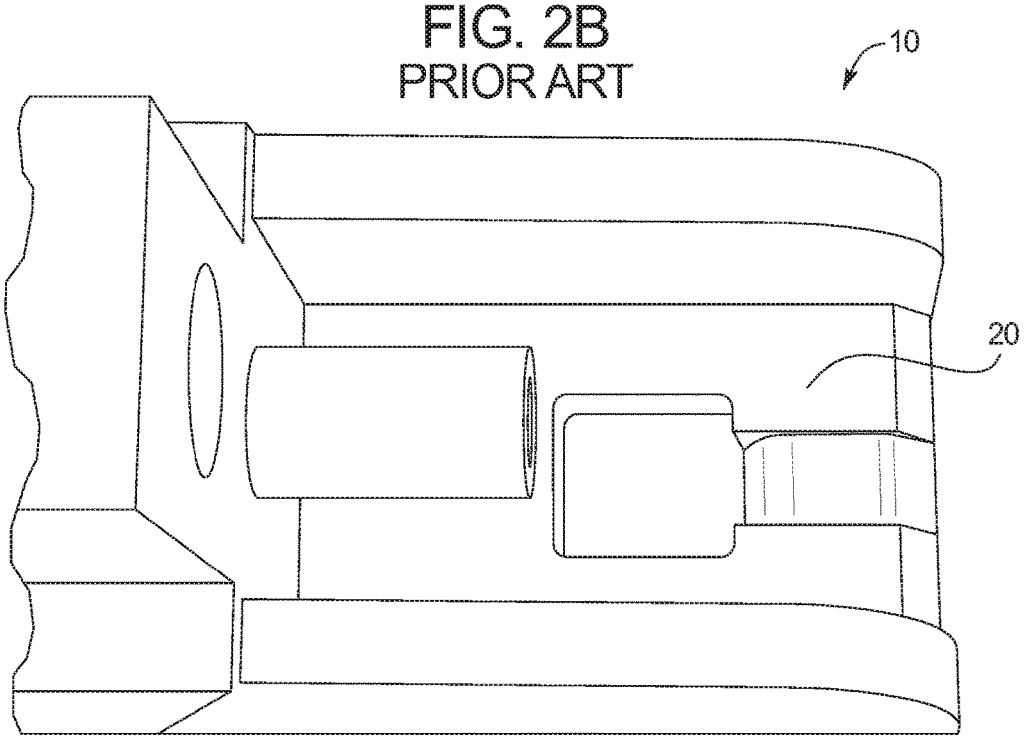
FIG. 2B PRIOR ART
FIG. 2B is a fragmentary top perspective view of a front or connection portion of the known commercially available electrical connector of FIG. 1, showing the wear on one of the engagement surfaces which occurs over time during use of such commercially available electrical connector.
Figure 3:
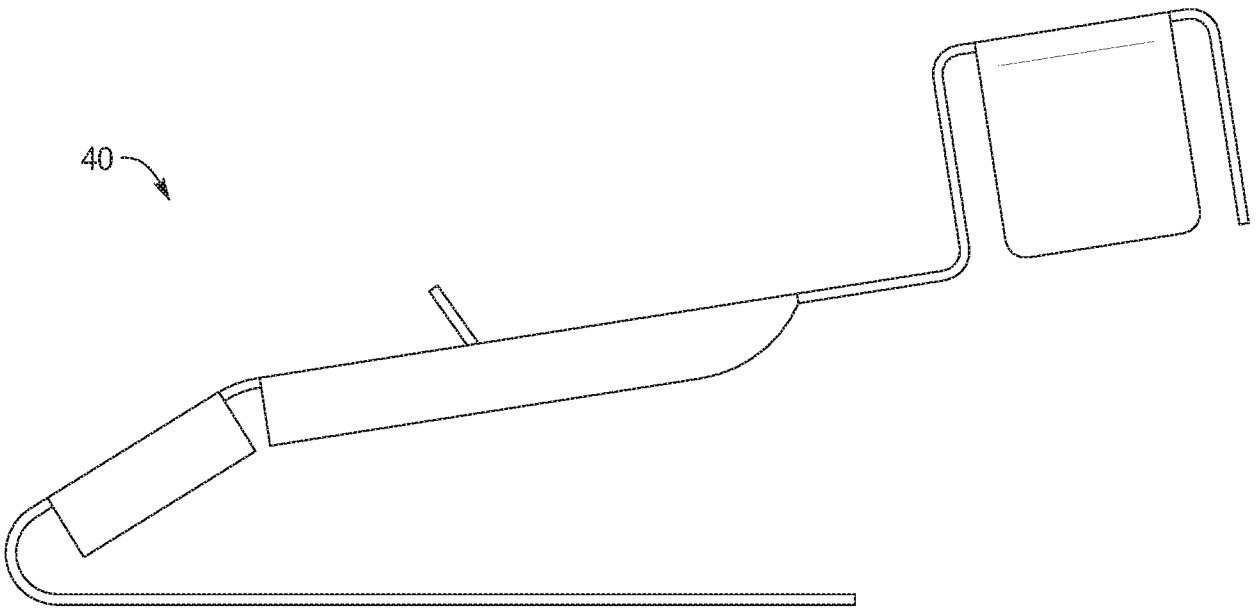
FIG. 3 PRIOR ART
FIG. 3 is a side perspective view of a portion or latch of the latching mechanism of the known commercially available electrical connector of FIG. 1.
Figure 4:
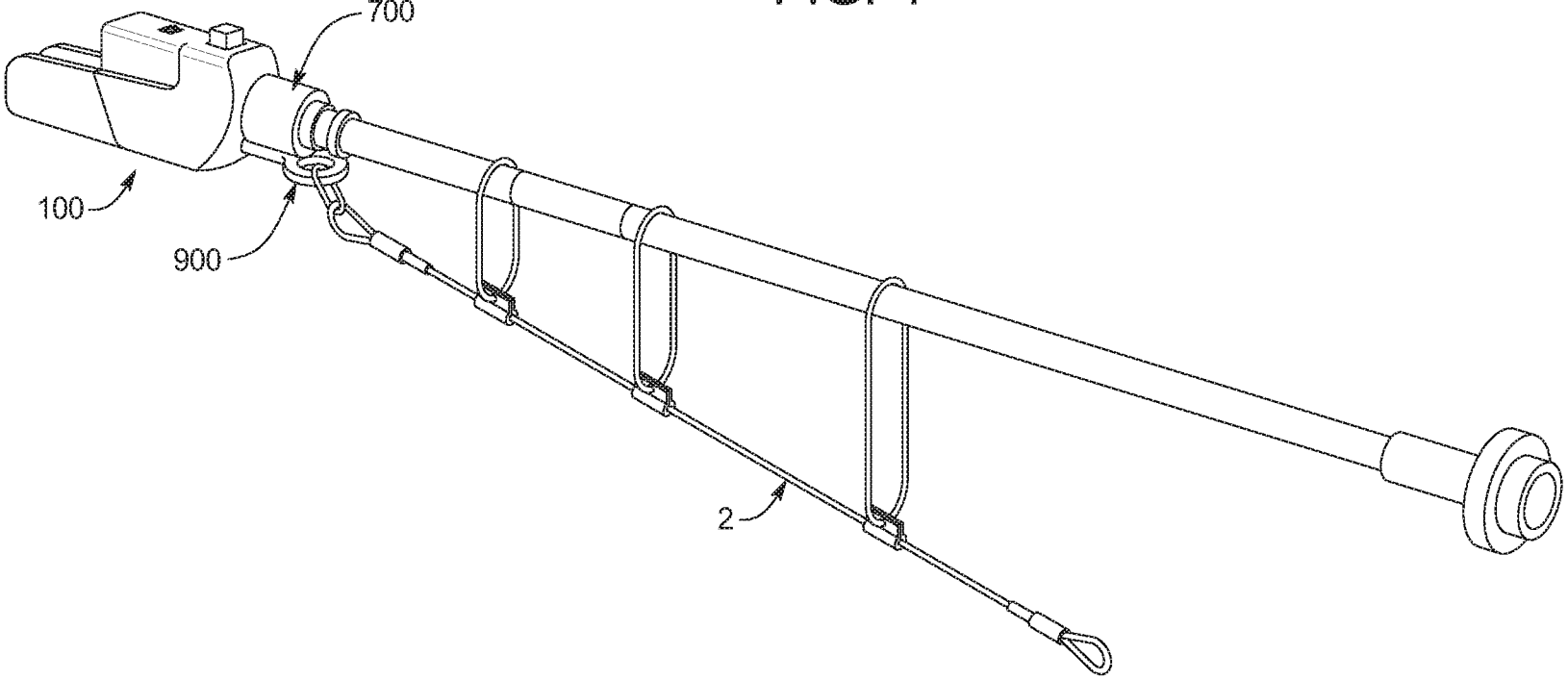
FIG. 4 is a perspective view of an electrical connector of one example embodiment of the present disclosure with the electrical cord connected thereto and with a supporting lanyard connected thereto.
Figure 5:
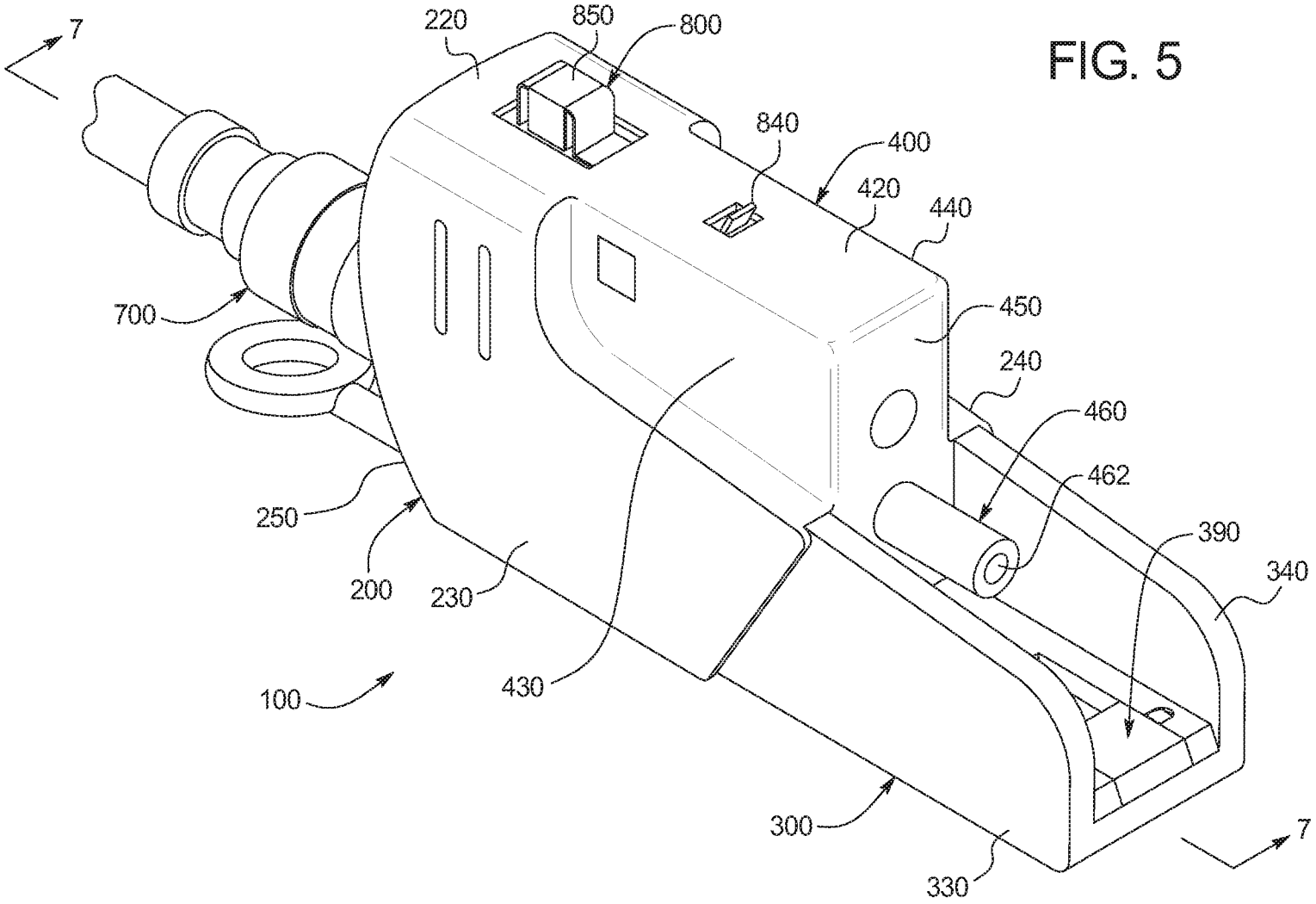
FIG. 5 is an enlarged top perspective view of the electrical connector of FIG. 4 (with the electrical cord connected thereto shown in fragmentary).

The latching mechanism 800 of this illustrated example embodiment of the present disclosure includes a one piece spring clip having: (a) a base 810; (b) a fulcrum or biasing end 820 connected to the base 810; (c) a straight actuation arm 830 connected to the fulcrum or biasing end 820; (d) a latch 840 connected to and extending transversely from the actuation arm 830; and (e) an actuation or release button 850 connected to and extending transversely from the end of the actuation arm 830 opposite the end 820. In this illustrated embodiment, the fulcrum or biasing end 820 has a greater or larger angle than the fulcrum or biasing end of the known latching mechanism of the electrical connector 10 shown in FIG. 3. This greater or larger angle reduces the force necessary to counter act the force exerted by the fulcrum or biasing end 820 when the release button 850 is actuated. In this illustrated embodiment, the actuation arm 830 also extends straight from the biasing end 820 to the actuation button 850. This reduces the force necessary to counter act the force exerted by the biasing end 820 when the release button 850 is actuated and the entire actuation arm 830 is pushed toward the base 810. Each of these two improvements individually and in combination provides a substantial reduction of force when compared to the amount of force needed to actuate the release button of the prior known latching mechanism shown in FIGS. 1 and 3. It should be appreciated that a suitable insert such as a foam insert can be employed in connection with the latching mechanism similar to the foam insert used with the known connector 10.

The securing assembly 900 of this illustrated example embodiment of the present disclosure includes: (a) an attachment shaft or pin 910 in or extending through the first end wall 250 of the base 200; and (b) a head 920 integrally connected to the outer end of the attachment shaft or pin 910. The head 920 is generally circular and is configured such that a connector supporting wire or chain can be attached to the head 920 to facilitate attachment of the electrical connector to the freight railroad car as is well known in the industry. The securing assembly 900 in this illustrated embodiment also includes suitable potting compound to further prevent any water ingress through the openings in the base that are configured to receive the attachment shaft or pin 910.

It should be appreciated from the above that when two electrical connectors 100 are connected to each other as generally shown in FIGS. 9 and 10, each releasable latching mechanism is oppositely disposed so that the electrical connected are inversely locked to each other at two separate independent different positions. More specifically, as shown in FIGS. 9 and 10, the latch 840 of each latching mechanism 800 extends into the respective opposing latch receiving area of the other electrical connector 100.

It should further be appreciated from the above that the present disclosure thus also provides a pair of electrical connectors that are identically configured to facilitate a quick connect mode and a quick disconnect mode for such electrical connectors.

It should further be appreciated from the above that to manually separate the connected electrical connectors 100 from each other as shown in FIGS. 9 and 10, both of the release buttons 850 of the respective latching mechanisms 800 of the respective electric connectors 100 need to be depressed in this illustrated example embodiment.

It should further be appreciated from the above that to automatically separate the connected electrical connectors 100 from each other as shown in FIGS. 9 and 10, the respective lanyards (see FIG. 4) connected to the two respective connected electrical connectors 100 are shorter than the respective electrical wires connected to the electrical connectors 100 and are thus subjected to suitable pulling or separation forces as well known in the rail industry. This provides a quick and easy separation of the two connected electrical connector without putting an excessive amount of force or strain on the electrical connectors or electrical wires or cables connected to such electrical connectors.

It should be understood that modifications and variations may be effected without departing from the scope of the novel concepts of the present invention, and it should be understood that this application is to be limited only by the scope of the claims.

The invention is claimed as follows:

1. An electrical connector comprising:

a latch strike plate;

a body having a base, a receiver extending from the base, the receiver including a first wall defining: (i) a recessed latch receiving area, and (ii) an adjacent recessed latch strike plate receiving area configured to receive the latch strike plate, and an inserter extending from the base;

a first electrical connection assembly in the body;

a second electrical connection assembly in the body;

an electrical linkage cable assembly connected to the base, the first electrical connection assembly, and the second electrical connection assembly; and a latching mechanism partially in the base and the inserter and partially extending from the base and the inserter.

2. The electrical connector of claim 1, wherein the latch receiving area is partially defined by an upstanding end wall of the latch strike plate.

3. The electrical connector of claim 1, wherein the latch receiving area is partially defined by: (a) an upstanding transverse first wall; (b) an upstanding first side wall; (c) an upstanding second side wall; and (d) a bottom wall extending transversely to the upstanding transverse first wall, the first side wall, and second side wall.

4. The electrical connector of claim 3, wherein the latch receiving area is further defined by an upstanding end wall of the latch strike plate.

5. The electrical connector of claim 1, wherein the latch strike plate includes a latch strike plate body and opposing attachment wings extending from the latch strike plate body.

6. The electrical connector of claim 5, wherein the latch strike plate receiving area includes opposing latch strike plate wing receipt areas configured to receive the opposing attachment wings of the latch strike plate.

7. The electrical connector of claim 5, wherein the latch strike plate receiving area is defined by: (a) an upstanding first side wall; (b) an upstanding first generally U-shaped side wing wall; (c) an upstanding second side wall; (d) an upstanding second generally U-shaped side wing wall; and (e) a bottom wall, wherein the first side wing wall, the second side wing wall, and the bottom wall define opposing latch strike plate wing receipt pockets that are configured to receive the opposing attachment wings of the latch strike plate.

8. The electrical connector of claim 1, wherein the latch strike plate includes a first outwardly extending attachment wing secured to the receiver and a second outwardly extending attachment wing secured to the receiver.

9. The electrical connector of claim 1, wherein the latch strike plate is secured to the receiver at multiple spaced apart positions of the receiver.

10. The electrical connector of claim 1, wherein the latch strike plate includes a solid latch strike plate body having: (a) a bottom flat surface; (b) a top surface; (c) an upstanding partially angled transversely extending first end wall extending from the bottom surface to the top surface; (d) an upstanding angled transversely extending second end wall extending from the bottom surface to the top surface; (e) an upstanding first side wall extending from the bottom surface to the top surface; (f) an upstanding second side wall extending from the bottom surface to the top surface; (g) a first attachment wing extending outwardly from the first side wall; and (h) a second attachment wing extending outwardly from the second side wall.

11. The electrical connector of claim 1, wherein the latching mechanism includes: (a) a base; (b) a biasing end connected to the base; (c) a straight actuation arm connected to the biasing end; (d) a latch connected to and extending transversely from the actuation arm; and (e) an actuation button connected to and extending transversely from the actuation arm.

12. The electrical connector of claim 1, wherein the base, the receiver, and the inserter are formed from a liquid crystal polymer.

13. The electrical connector of claim 1, which includes a securing assembly extending in and from the base.

14. The electrical connector of claim 1, wherein the latch strike plate is molded into the strike plate receiving area during molding of the body.

15. The electrical connector of claim 1, wherein the first electrical connection assembly includes: (a) a first electrical member including an electrical socket fixedly positioned in and extending through a first longitudinally extending cavity defined by the inserter; (b) a first O-ring extending in the first longitudinally extending cavity and around the first electrical member; and (c) potting compound positioned partially around the first electrical member, wherein the O-ring prevents the potting compound from leaking into the electrical socket, and prevents water from entering through space between the first electrical member and interior wall that defines the first cavity.

16. The electrical connector of claim 15, wherein the first electrical member including the electrical socket is made from a beryllium copper.

17. The electrical connector of claim 16, wherein the first electrical member including the electrical socket is also gold plated.

18. The electrical connector of claim 15, wherein the first electrical connection assembly includes an enhanced engagement seal between an outer surface of the first electrical member and an inner surface of the inserter that defines the first cavity.

19. The electrical connector of claim 15, wherein the first electrical connection assembly includes an enhanced cylindrical tapered engagement seal between an outer surface of the first electrical member and an inner surface of the inserter that defines the first cavity.

20. The electrical connector of claim 15, wherein the second electrical connection assembly includes: (a) a second electrical member including an electrical post fixedly positioned in and extending through a second longitudinally extending cavity defined by the inserter; (b) a second O-ring extending in the second longitudinally extending cavity and around the second electrical member; and (c) potting compound positioned partially around the second electrical member, wherein the O-ring prevents the potting compound from leaking onto the electrical post, and prevents water from entering through space between the second electrical member and interior wall that defines the second cavity.

21. The electrical connector of claim 20, wherein the second electrical member including the electrical post is made from a conductive beryllium copper.

22. The electrical connector of claim 21, wherein the second electrical member including the electrical post is also gold plated.

23. The electrical connector of claim 1, wherein the second electrical connection assembly includes: (a) a second electrical member including an electrical post fixedly positioned in and extending through a second longitudinally extending cavity defined by the inserter; (b) a second O-ring extending in the second longitudinally extending cavity and around the second electrical member; and (c) potting compound positioned partially around the second electrical member, wherein the O-ring prevents the potting compound from leaking onto the electrical post, and prevents water from entering through space between the second electrical member and interior wall that defines the second cavity.

24. The electrical connector of claim 23, wherein the second electrical member including the electrical post is made from a 95% conductive copper alloy.

25. The electrical connector of claim 24, wherein the second electrical member including the electrical post is also gold plated.

26. An electrical connector comprising:

a latch strike plate, the latch strike plate including a latch strike plate body and opposing attachment wings extending from the latch strike plate body;

a body having a base, a receiver extending from the base, the receiver defining: (i) a latch receiving area, the latch receiving area partially defined by: (a) an upstanding transverse first wall; (b) an upstanding first side wall; (c) an upstanding second side wall; and (d) a bottom wall extending transversely to the upstanding transverse first wall, the first side wall, and second side wall, (ii) an adjacent latch strike plate receiving area configured to receive the latch strike plate, wherein the latch receiving area is further defined by an upstanding end wall of the latch strike plate, and wherein the latch strike plate receiving area includes opposing latch strike plate wing receipt areas configured to receive the opposing attachment wings of the latch strike plate;

an inserter extending from the base;

a first electrical connection assembly in the body, wherein the first electrical connection assembly includes: (a) a first electrical member including an electrical socket fixedly positioned in and extending through a first longitudinally extending cavity defined by the inserter; (b) a first O-ring extending in the first longitudinally extending cavity and around the first electrical member; and (c) potting compound positioned partially around the first electrical member, wherein the O-ring prevents the potting compound from leaking into the electrical socket, and prevents water from entering through space between the first electrical member and interior wall that defines the first cavity;

a second electrical connection assembly in the body, wherein the second electrical connection assembly includes: (a) a second electrical member including an electrical post fixedly positioned in and extending through a second longitudinally extending cavity defined by the inserter; (b) a second O-ring extending in the second longitudinally extending cavity and around the second electrical member; and (c) potting compound positioned partially around the second electrical member, wherein the O-ring prevents the potting compound from leaking onto the electrical post, and prevents water from entering through space between the second electrical member and interior wall that defines the second cavity;

an electrical linkage cable assembly connected to the base, the first electrical connection assembly, and the second electrical connection assembly; and a latching mechanism partially positioned in the base and the inserter and partially extending from the base and the inserter, wherein the latching mechanism includes: (a) a base; (b) a biasing end connected to the base; (c) a straight actuation arm connected to the biasing end; (d) a latch connected to and extending transversely from the actuation arm; and (e) an actuation button connected to and extending transversely from the actuation arm.

27. The electrical connector of claim 26, wherein the base, the receiver, and the inserter are formed from a liquid crystal polymer.

28. The electrical connector of claim 26, wherein the latch strike plate is molded into the strike plate receiving area.

29. The electrical connector of claim 26, wherein the first electrical member including the electrical socket is made from a beryllium copper.

30. The electrical connector of claim 29, wherein the first electrical member including the electrical socket is also gold plated.

31. The electrical connector of claim 26, wherein the first electrical connection assembly includes an enhanced engagement seal between an outer surface of the first electrical member and an inner surface of the inserter that defines the first cavity.

32. The electrical connector of claim 26, wherein the first electrical connection assembly includes an enhanced cylindrical tapered engagement seal between an outer surface of the first electrical member and an inner surface of the inserter that defines the first cavity.

33. The electrical connector of claim 26, wherein the electrical socket defines an interior threaded surface configured to threadably receive a threaded assembly tool during an assembly process.

34. The electrical connector of claim 26, wherein the second electrical member including the electrical post is made from a conductive beryllium copper.

35. The electrical connector of claim 34, wherein the second electrical member including the electrical post is also gold plated.

36. The electrical connector of claim 26, wherein the second electrical member including the electrical post is made from a 95% conductive copper alloy.

37. The electrical connector of claim 36, wherein the second electrical member including the electrical post is also gold plated.

38. The electrical connector of claim 15, wherein the electrical socket defines an interior threaded surface configured to receive a threaded assembly tool during an assembly process.

39. An electrical connector comprising:

a latch strike plate including a latch strike plate body and opposing attachment wings extending from the latch strike plate body;

a body having a base, a receiver extending from the base, the receiver defining: (i) a latch receiving area, and (ii) an adjacent latch strike plate receiving area configured to receive the latch strike plate, and an inserter extending from the base, wherein the latch strike plate receiving area is defined by: (a) an upstanding first side wall; (b) an upstanding first generally U-shaped side wing wall; (c) an upstanding second side wall; (d) an upstanding second generally U-shaped side wing wall; and (e) a bottom wall, wherein the first side wing wall, the second side wing wall, and the bottom wall define opposing latch strike plate wing receipt pockets that are configured to receive the opposing attachment wings of the latch strike plate;

a first electrical connection assembly in the body;

a second electrical connection assembly in the body;

an electrical linkage cable assembly connected to the base, the first electrical connection assembly, and the second electrical connection assembly; and a latching mechanism partially in the base and the inserter and partially extending from the base and the inserter.

40. An electrical connector comprising:

a latch strike plate;

a body having a base, a receiver extending from the base, the receiver defining: (i) a latch receiving area, and (ii) an adjacent latch strike plate receiving area configured to receive the latch strike plate, and an inserter extending from the base;

a first electrical connection assembly in the body, wherein the first electrical connection assembly includes: (a) a first electrical member including an electrical socket fixedly positioned in and extending through a first longitudinally extending cavity defined by the inserter; (b) a first O-ring extending in the first longitudinally extending cavity and around the first electrical member; and (c) potting compound positioned partially around the first electrical member, wherein the O-ring prevents the potting compound from leaking into the electrical socket, and prevents water from entering through space between the first electrical member and interior wall that defines the first cavity;

a second electrical connection assembly in the body;

an electrical linkage cable assembly connected to the base, the first electrical connection assembly, and the second electrical connection assembly; and a latching mechanism partially in the base and the inserter and partially extending from the base and the inserter.

41. The electrical connector of claim 40, wherein the first electrical member including the electrical socket is made from a beryllium copper.

42. The electrical connector of claim 41, wherein the first electrical member including the electrical socket is also gold plated.

43. The electrical connector of claim 40, wherein the first electrical connection assembly includes an enhanced engagement seal between an outer surface of the first electrical member and an inner surface of the inserter that defines the first cavity.

44. The electrical connector of claim 40, wherein the first electrical connection assembly includes an enhanced cylindrical tapered engagement seal between an outer surface of the first electrical member and an inner surface of the inserter that defines the first cavity.

45. The electrical connector of claim 40, wherein the second electrical connection assembly includes: (a) a second electrical member including an electrical post fixedly positioned in and extending through a second longitudinally extending cavity defined by the inserter; (b) a second O-ring extending in the second longitudinally extending cavity and around the second electrical member; and (c) potting compound positioned partially around the second electrical member, wherein the O-ring prevents the potting compound from leaking onto the electrical post, and prevents water from entering through space between the second electrical member and interior wall that defines the second cavity.

46. The electrical connector of claim 45, wherein the second electrical member including the electrical post is made from a conductive beryllium copper.

47. The electrical connector of claim 46, wherein the second electrical member including the electrical post is also gold plated.

48. The electrical connector of claim 40, wherein the electrical socket defines an interior threaded surface configured to receive a threaded assembly tool during an assembly process.

* * * * *